United States Patent [19]

Bohg et al.

[11] Patent Number: 4,688,012

[45] Date of Patent: Aug. 18, 1987

[54] ELECTROMAGNETIC ACTUATOR MECHANISM IN PARTICULAR FOR PRINT HAMMER DRIVES

[75] Inventors: Armin Bohg, Weil-Neuweiler; Ludwig Fischer, Herrenberg-Kuppingen; Bruno Gantz, Herrenberg; Kurt Hartmann, Calw-Heumaden; Gerhard Wolfert, Stuttgart, all of Fed. Rep. of Germany

[73] Assignee: International Business Machines Corporation, Armonk, N.Y.

[21] Appl. No.: 909,989

[22] Filed: Sep. 22, 1986

[51] Int. Cl.[4] ..... H01F 7/08

[52] U.S. Cl. ..... 335/276; 335/281

[58] Field of Search ..... 335/255, 261, 262, 279, 335/276, 281, 270

[56] References Cited

U.S. PATENT DOCUMENTS

| | | | |
|---|---|---|---|
| 3,745,496 | 7/1973 | Tichy | 335/281 X |
| 3,993,972 | 11/1976 | Barbrook | 335/281 X |
| 4,438,420 | 3/1984 | Leiber et al. | 335/261 X |
| 4,633,209 | 12/1986 | Belbel et al. | 335/279 X |

*Primary Examiner*—George Harris

*Attorney, Agent, or Firm*—John S. Gasper

[57] ABSTRACT

Upon excitation of the electromagnet, a clapper armature is pulled into an operating gap, being increasingly additionally attracted by the pole of an electromagnet yoke leg.

The motional plane of the clapper armature extends perpendicularly to the plane of the magnetic flux of the yoke structure of the electromagnet.

6 Claims, 8 Drawing Figures

ELECTROMAGNETIC ACTUATOR MECHANISM IN PARTICULAR FOR PRINT HAMMER DRIVES

The invention concerns an electromagnetic actuator mechanism with a clapper armature and an electromagnet of the type characterized in the preamble of claim 1.

This actuator mechanism is perferably used in impact printers. It combines the advantages of two different principles of known electromagnetic actuator mechanisms, namely, the principle of conventional clapper armature electromagnets and the principle of an actuator described in the European Patent Application No. 80 103 387.9 (GE9-80-014E), which is used as a high-speed electromagnetically operated ram actuator in particular for impact printers. The electromagnet basically consists of substantially symmetrically designed magnetizable yoke halves with excitation coil(s). The facing pole ends of the yoke halves form aligned magnetic operating gaps. A ram movable in the direction of the line of alignment of the operating gaps is positioned between the magnetic operating gaps. The cross-section of the ram is adapted to the cross-section of the operating gaps and may be of a cylindrical or cuboid shape. The ram comprises, for example disk- or cuboid-shaped armature elements of magnetizable material, between which spacers of predominantly non-magnetizable material are arranged. The armature elements are geometrically shaped such that their volume is of the order of the operating gap volume. In the starting position of the ram in the non-excited state of the electromagnet, the armature elements are positioned essentially external to the operating gaps of the electromagnet. Upon excitation of the latter, they are pulled inside the operating gaps and accelerated in the process.

However, ram actuators of this type have the disadvantage that they are highly susceptible to lateral force dissymmetries.

Figure 1:
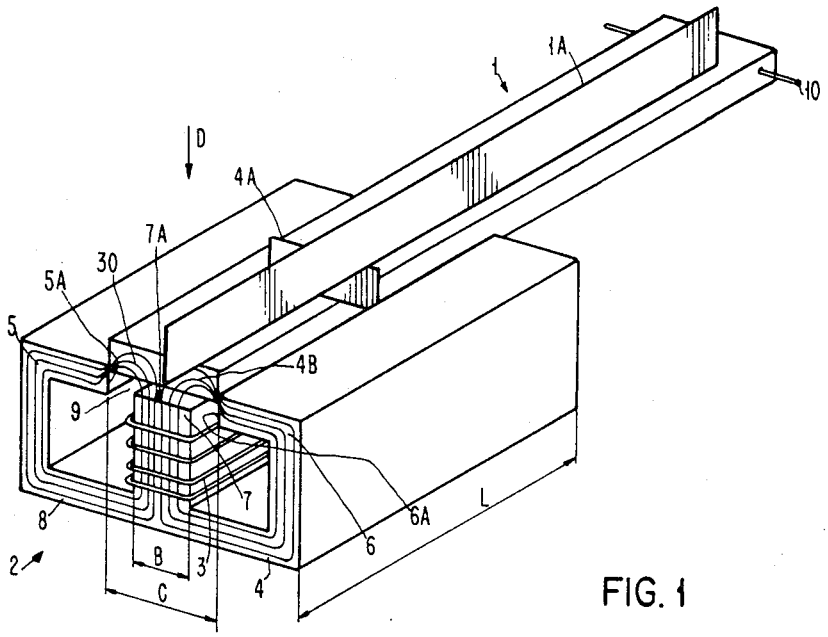

Conventional clapper armature electromagnetic actuators, as are widely used in printers IBM 1403 (also see IBM Technical Disclosure Bulletin Vol. 16, No. 11, April 1974, p. 3529, FIG. 1) have the disadvantage of consuming much space although their electromechanical efficiency is only a few per cent.

It is the object of the invention to provide an actuator mechanism of the above-described type with a high force, a short operating time and minimum space requirements.

This object of the invention is favourably accomplished by the measures specified in the characterization of claim 1, i.e., by a combination of the afore-mentioned principles.

Further favourable embodiments of the invention are covered by the subclaims.

Figure 2:
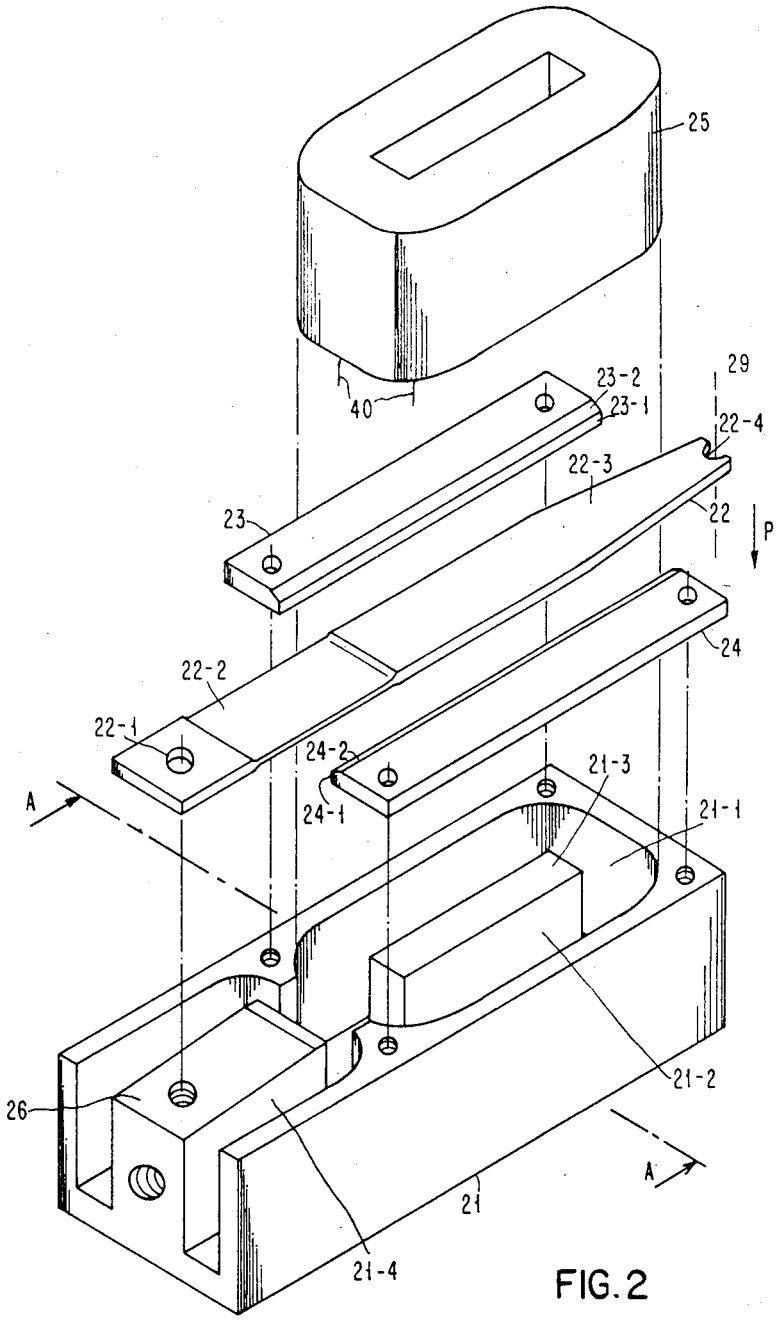
Figure 3:
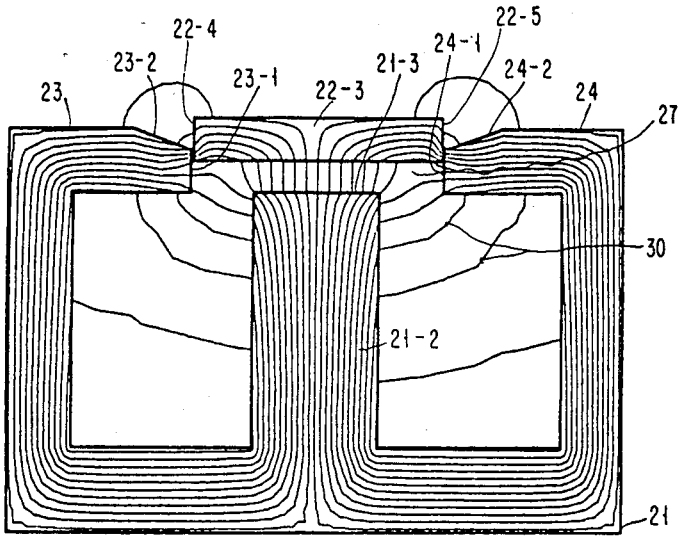

Embodiments of the invention are described in detail below with reference to drawings, in which FIG. 1 is a schematic perspective representation of the electromagnetic actuator mechanism in accordance with the invention, comprising a clapper armature and a special yoke structure, FIG. 2 is a perspective exploded view of the electromagnetic actuator mechanism according to the invention for use in impact printers, FIG. 3 is a sectional view along line A—A of FIG. 2, representing the magnetic flux path in the magnet yoke structure and the clapper armature, FIGS. 4A to 4E are cutout sectional views in analogy to FIG. 3 with different cross-sectional shapes for the clapper armature and the magnet yoke structure.

Upon excitation of the electromagnet, the clapper armature 1 moves in the arrow-marked direction D, performing a pivotal motion about its axis 10. The motional plane of clapper armature 1 extends perpendicularly to the magnetic flux plane 4A of the yoke structure 4 of the electromagnet 2. Viewed in the magnetic flux plane 4A, the yoke structure has a substantially E-shaped cross-section with two outer legs 5 and 6, one center leg 7 and a base 8 common to all legs. The pole face *7a* of the center leg 7, encompassed by the excitation coil 3, faces the clapper armature 1. The free ends of the outer legs 5 and 6 are bent towards each other such that a magnetic operating gap 9 is formed between their pole faces 5A and 6A . The pole face 7A of the center leg 7 may be outside or inside the operating gap 9.

When the electromagnet 2 is excited, clapper armature 1 is pulled into operating gap 9, being additionally increasingly attracted by the pole face 7A of the center leg 7, with substantially half of the magnetic flux passing across the clapper armature 1 to one of the pole faces 5A, 6A of the outer legs 5 and 6. The width B of the clapper armature 1 is substantially less than its length between the pivotal axis 10 and operating gap 9. The magnetic flux passing through the actuator mechanism is represented by a multitude of magnetic flux lines 4B. The local magnetic flux density is the higher the denser these lines are. Yoke structure and clapper armature are positioned substantially symmetrically to the clapper armature's motional plane 1A extending through the center of the center leg 7. The moving end of the clapper armature may be designed for switching or impact motions.

FIG. 2 is a perspective exploded view of the electromagnetic actuator mechanism according to the invention for use in impact printers.

This mechanism primarily consists of five elements: the base element 21 of soft-magnetic material, the electromagnet coil 25 to be inserted into base element 21, two yoke bars 23 and 24 to be fixed to the base element, and clapper armature 22 to be connected to the base element. The base element has a recess 21-1 and a center leg 21-2 with the pole face 21-3 positioned therein. The recess serves to accommodate the electromagnet coil 25. As shown in FIG. 2, the yoke bars 23 and 24 are connected to the periphery of the base element by means of screw connections, welded joints or the like. Between the pole faces 23-1, 24-1 of the yoke bars the operating gap is positioned. The clapper armature 22 itself has one end fixed to an inclined surface of a block 26. Block 26 is arranged in a recess in the front portion of base element 21. Recesses 21-1 and 21-4 are interconnected so that the coil connections 40 can be readily led to the outside. The portion of the clapper armature close to the fixing end is formed by a leaf spring 22-2. It permits a pivotal motion when the clapper armature is pulled into the operating gap upon excitation of the electromagnet. The free end of the clapper armature is provided with a recess 22-4 interacting with a print ram 29 (marked by broken lines) to generate a ram movement in the direction P. The inner edges of the yoke bars 23 and 24 may be inclined 23-2, 24-2 to suit a particular operating gap shape.

FIG. 3 is a sectional view along line A—A in FIG. 2, representing the magnetic flux path in the magnet yoke structure and the clapper armature.

In FIG. 3 the magnetic flux lines 30 are represented by thin solid lines. The magnetic flux density is the higher the denser these lines are. The sectional view shows part of armature 22-3 pulled into operating gap 27. The forces occurring in the initial phase when the armature is pulled into the operating gap are mainly a function of the forces of attraction occurring between the lateral faces 22-4 and 22-5 of the clapper armature 22-3 and the pole faces 23-1 and 24-1 (between which the operating gap is formed). This principle of an electromagnetic actuator is known from the previously mentioned European Patent Application No. 80 103 387.9.

As the clapper armature 22-3 is being pulled farther into the operating gap, it is increasingly additionally attracted by the pole face 21-3 of the center leg 21-2. This kind of attraction between a clapper armature and the yoke of an electromagnet is generally known (e.g. from the print hammer drives of IBM system 1403). In that known system, the planes of the magnetic flux extend differently from those of the mechanism according to the invention (e.g. in the pivotal plane).

The reference numerals of FIG. 3 correspond to those in FIG. 2.

The mechanism according to the invention combines the advantages of an electromagnetic actuator mechanism according to the European Patent Application No. 80 103 387.9 with those of the conventional clapper armature systems.

FIGS. 4A to 4E are cutout sectional views in analogy to FIG. 3 with different cross-sectional shapes for the clapper armature and the magnet yoke structure.

The magnetic lines in the yoke, the operating gap and in the vicinity of the yoke are marked by solid lines. The magnetic flux density is the higher the denser these lines are. By specially designing the clapper armature cross-section and by inclining the free yoke leg ends, special magnetic fluxes having specific advantages are obtained.

Figure 4A:
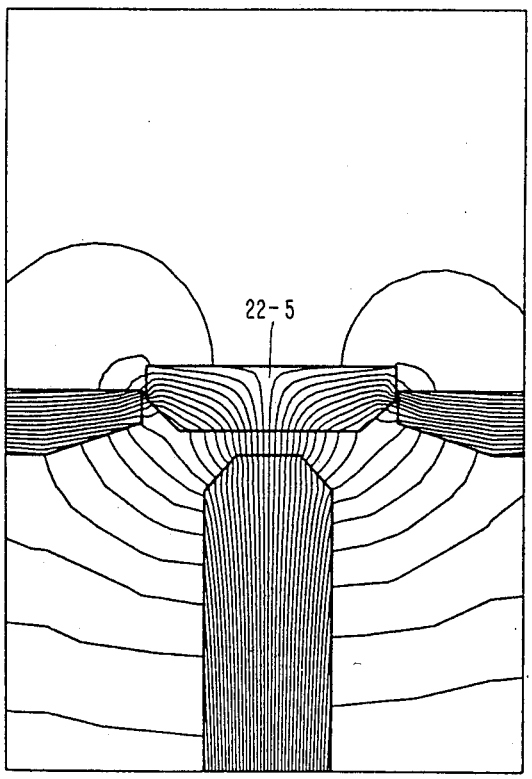
Figure 4B:
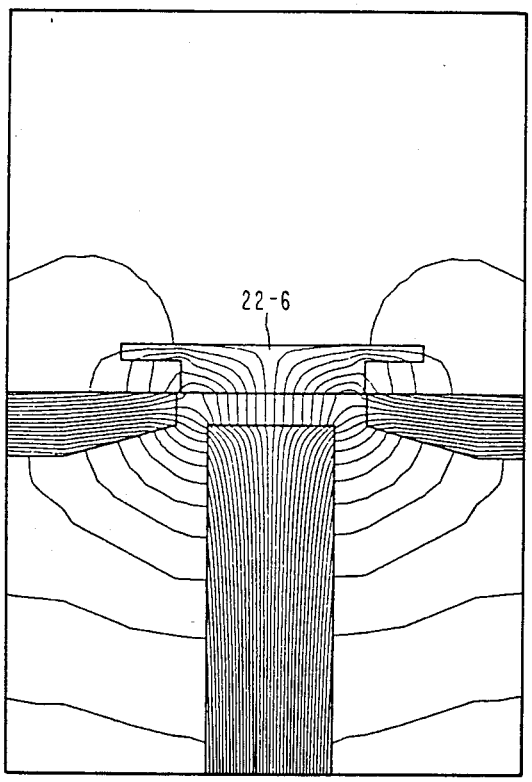

FIG. 4A clapper armature and yoke leg ends with inclined inner edges advantage—low lateral forces with the clapper armature being asymmetrically positioned in the operating gap (particularly at the end of acceleration).

Figure 4C:
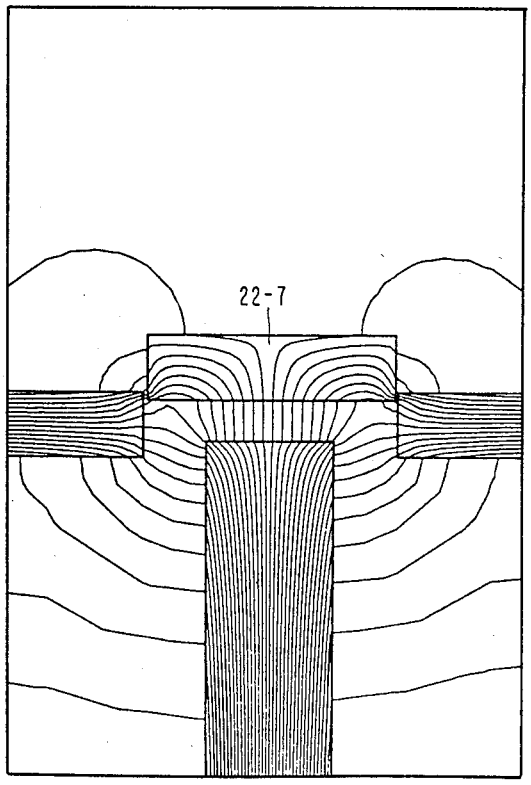

4B T-shaped clapper armature and outer yoke leg ends whose inner edges are inclined advantage—high energy, short travel FIG. 4C clapper armature with rectangular cross-section advantage—easy to manufacture, small armature mass.

Figure 4D:
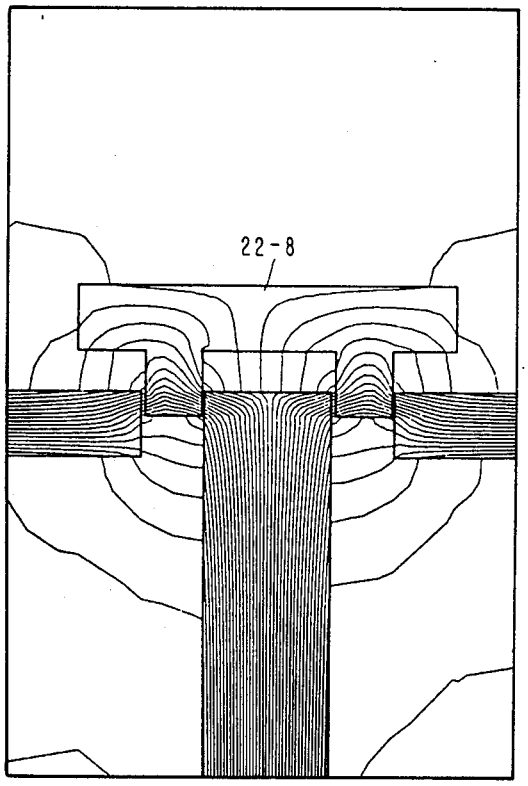

FIG. 4D clapper armature with $\pi$-shaped cross-section advantage—high initial acceleration.

Figure 4E:
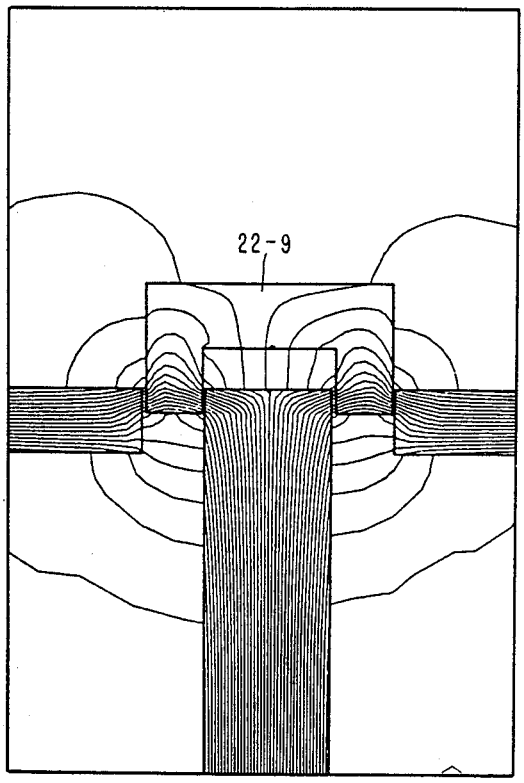

FIG. 4E clapper armature with (inversely) U-shaped cross-section advantage—high initial acceleration at lower lateral forces than with the embodiment according to FIG. 4D.

We claim:

1. Electromagnetic actuator mechanism for switching, stroke and impact motions, comprising a clapper armature and an electromagnet consisting of an excitation coil and a magnetizable yoke structure, wherein the clapper armature is attracted by the yoke structure upon excitation of the electromagnet, characterized in that the motional plane of the clapper armature extends perpendicularly to the plane of the magnetic flux of the yoke structure of the electromagnet, the yoke structure, viewed in the magnetic flux plane, has a substantially E-shaped cross-section with two outer legs and one center leg and a base common to all legs, wherein the pole face of the center leg, encompassed by the excitation coil, faces the clapper armature, and the free ends of the outer legs are so bent in a direction towards each other that a magnetic operating gap is formed between their pole faces, outside or inside of which the pole face of the center leg is positioned, upon excitation of the electromagnet, the clapper armature is pulled inside the operating gap, being increasingly attracted by the pole face of the center leg, with substantially half of the magnetic flux of the center leg passing across the clapper armature to one pole face of the operating gap, and the length of the clapper armature between its pivotal axis and the operating gap is more than twice the width of the clapper armature between the pole faces of the operating gap.

2. Mechanism according to claim 1, characterized in that the yoke structure is positioned symmetrically to the motional plane of the clapper armature extending through the center of center leg.

3. Mechanism according to claim 2, characterized in that the width of the pole face of the center leg amounts to substantially half the distance of the pole faces of the outer legs forming the operating gap.

4. Mechanism according to any one of the claims 1 to 3, characterized in that a leaf spring support serves to pivot the clapper armature.

5. Mechanism according to any one of the claims 1 to 3, characterized in that the clapper armature in the plane of the magnetic flux has a rectangular cross-section, an assumed rectangular cross-section with inclinded edges, a T-shaped, a U-shaped or a $\pi$-shaped cross-section.

6. Mechanism according to any one of the claims 1 to 3, characterized in that it is used for impact printers.

* * * * *